US005429310A

United States Patent [19]

Keller et al.

[11] Patent Number: 5,429,310

[45] Date of Patent: Jul. 4, 1995

[54] METHOD AND ARRANGEMENT FOR PROCESSING OR REPROCESSING WASTE MATERIAL ACCUMULATING IN THE PRODUCTION OR PROCESSING OF CIGARETTES

[75] Inventors: Karsten Keller, Waldbronn; Peter Scheer, Ettenheim, both of Germany

[73] Assignee: Rhone-Poulenc Rhodia Aktiengesellschaft, Freiburg, Germany

[21] Appl. No.: 91,344

[22] Filed: Jul. 14, 1993

[30] Foreign Application Priority Data

Jun. 16, 1993 [DE] Germany ..... 43 19 957.7

[51] Int. Cl.[6] ..... B02C 23/30

[52] U.S. Cl. ..... 241/14; 241/19; 241/24; 241/79.1; 131/96

[58] Field of Search ..... 241/14, 19, 24, 27, 241/60, 79, 79.1, 189.1; 131/96

[56] References Cited

U.S. PATENT DOCUMENTS

| | | | |
|---|---|---|---|
| 1,760,097 | 5/1930 | Williams | 241/192 |
| 3,004,721 | 10/1961 | Nötold | 241/14 X |
| 3,074,653 | 1/1963 | Schorsch | 241/14 |
| 3,577,999 | 5/1971 | Pinkham | 131/96 |
| 3,963,181 | 6/1976 | Deloy et al. | 241/79.1 X |
| 4,083,499 | 4/1978 | Thatcher | 241/52 X |
| 4,278,100 | 7/1981 | Thatcher | 241/47 X |
| 4,618,415 | 10/1986 | Vecchio et al. | 241/79.1 X |
| 4,651,757 | 3/1987 | Ohyatsu et al. | 241/154 X |
| 5,092,529 | 3/1992 | Bechler | 241/192 |

FOREIGN PATENT DOCUMENTS

| | | | |
|---|---|---|---|
| 1208100 | 7/1986 | Canada | 131/96 |
| 1051395 | 10/1951 | France | 241/14 |
| 894226 | 10/1953 | Germany | 131/96 |
| 2307075 | 8/1974 | Germany | 131/96 |
| 3125180 | 1/1983 | Germany | 131/96 |

*Primary Examiner*—Timothy V. Eley
*Attorney, Agent, or Firm*—Bucknam and Archer

[57] ABSTRACT

A method and an apparatus for carrying out the method are described which are used for reprocessing waste material accumulating in the production of cigarettes and similar rod-form smoking items, wherein the waste material comprises paper material, tobacco and filter material, wherein the paper material is wrapped around the tobacco, and wherein essentially the following process steps are carried out: the waste material is subjected to a dry mechanical treatment in order to obtain waste material which is broken down and in which the material components of the waste material are separated one from the other, and in particular the paper material is detached from the tobacco or the other material components, and the tobacco is subsequently sifted out of the broken-down waste material. The paper material can be suctioned out of the broken-down waste material after the tobacco has been sifted out.

15 Claims, 2 Drawing Sheets

Figure 1:
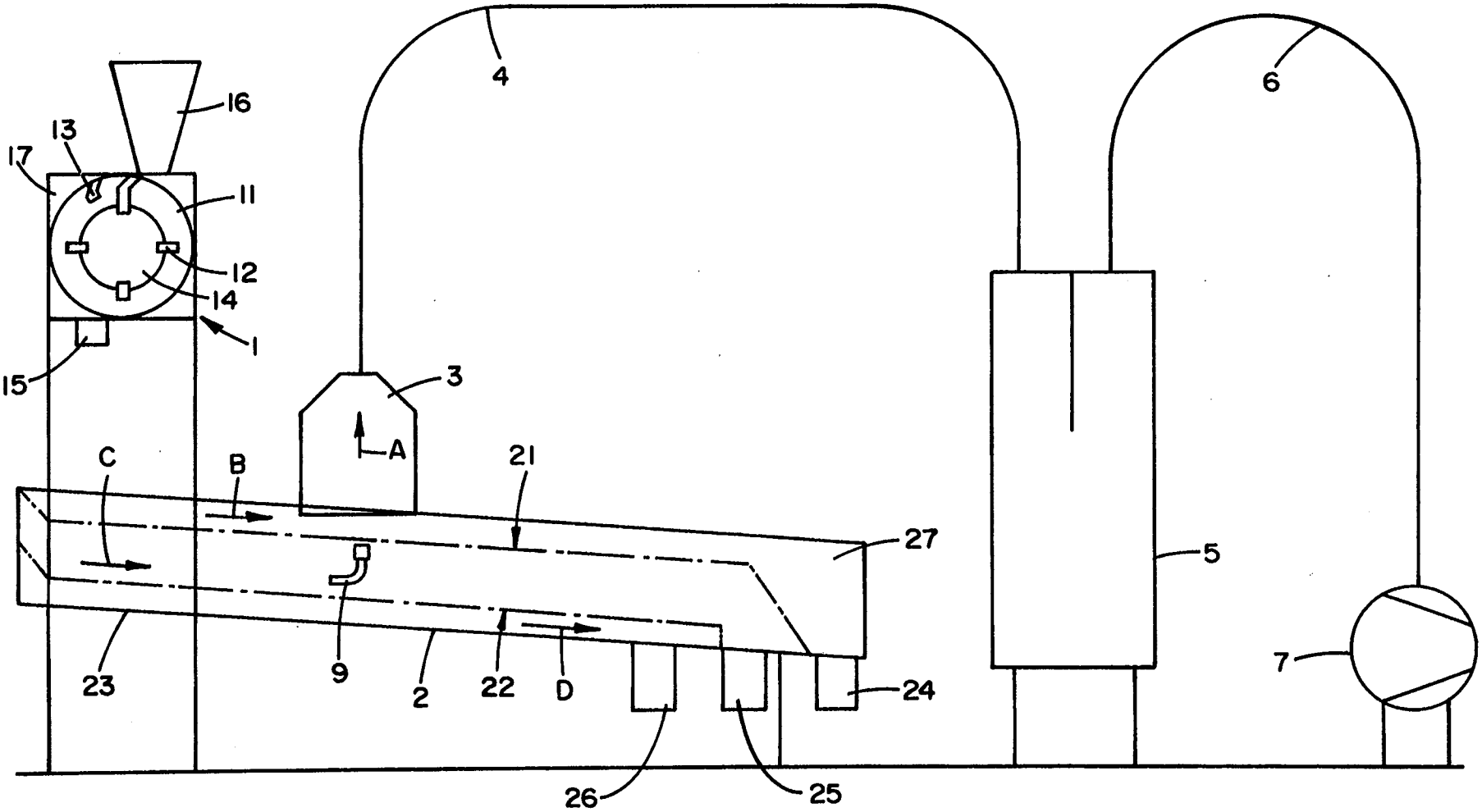

METHOD AND ARRANGEMENT FOR PROCESSING OR REPROCESSING WASTE MATERIAL ACCUMULATING IN THE PRODUCTION OR PROCESSING OF CIGARETTES

FIELD OF THE INVENTION

The present invention relates to a method and a device provided for carrying out the method for processing or reprocessing discarded material which accumulates in the production or processing of cigarettes and similar rod-form smoking items, wherein the discarded material comprises paper materials, tobacco and potentially additional material components such as for example filter materials, and wherein the paper material is wrapped around the tobacco and potentially connected to the filter material.

In the production of for example cigarettes, first filter rods are generated from so-called filter tow strips which comprise cellulose acetate filaments. The filter tow strip(s) is (are) pulled off pack or stack and further processed on a filter rod machine to form filter strands around which is wrapped paper, whereupon finally individual filter rods are generated by cutting the filter strands. These filter rods are cylindrical units around which is wrapped paper having a length of approximately 66 to 150 mm and a diameter of for example 4 mm to 10 mm. Each filter rod normally comprises enough material for four or six filter pieces or filter plugs which are wrapped with paper (tipping) later fastened on cigarette rods comprising paper-wrapped tobacco in order to generate filter cigarettes.

In the production of filter cigarettes by cigarette machines discarded material is produced for example when charging the machine. This discarded material or "waste" comprises valuable substances or materials such as for example the filter material or the filter plugs with tipping, the tobacco, wrapping paper for the tobacco, etc.

SUMMARY OF THE INVENTION

It is the object of the present invention to provide a method and an associated apparatus by which the valuable material components present in discarded cigarette material can be recovered with a high yield and in a way which saves energy.

Accordingly, in the method according to the invention the waste material is first subjected to a dry mechanical processing in order to obtain waste material which is broken down into its components, in which the material components of the waste material are separated from one another, and in particular the paper material is detached or separated from the other material components such as the tobacco.

By "dry mechanical" is understood a mechanical action on the waste material in which for example through tearing, shearing and impact actions on the waste material the material components of the waste material are separated from one another, wherein this mechanical separation process takes place under dry conditions, consequently without the use of a liquid or a fluid and the waste material itself is present in the dry state.

The waste material taken apart in the first step is subsequently sifted in order to sort the tobacco from the material broken down. Therein the broken-down waste material can be made to oscillate or vibrate and can be spread out.

From the waste material spread out in this way the paper material which has already been detached or separated from the other material components, in particular from the tobacco of the discard, and which is comprised in the waste material can be suctioned off in order to sort out or select the paper material.

Before the sifting or suctioning "broken-down waste material" is already present, i.e. while the paper material, the tobacco and for example the filter plugs with tipping are still mixed together, through the separation of the waste material carried out previously, the paper is no longer connected with for example the tobacco or the filter material so that suctioning of the paper material or separation of the tobacco by sifting becomes possible.

For carrying out the method according to the invention a separating device and a sorting device are used which accepts the waste material, processed and broken down by the separating device, for sorting the individual material components of the broken-down waste material.

The sorting device can be layed out as a vibrating conveyor which can comprise several vibrating sieves for sifting and sorting the tobacco in the broken-down waste material. For suctioning off the paper material a blower-operated suctioning device can be used provided for example with a suction hood disposed above the waste material.

A blowing device is preferably used in addition which blows a stream of air onto the broken-down waste material facilitating the removal of the paper material from the waste material.

By the method according to the invention or the associated apparatus the filter material with tipping as well as also the tobacco of the cigarette discards can be recovered.

BRIEF DESCRIPTION OF THE INVENTION

Figure 2:
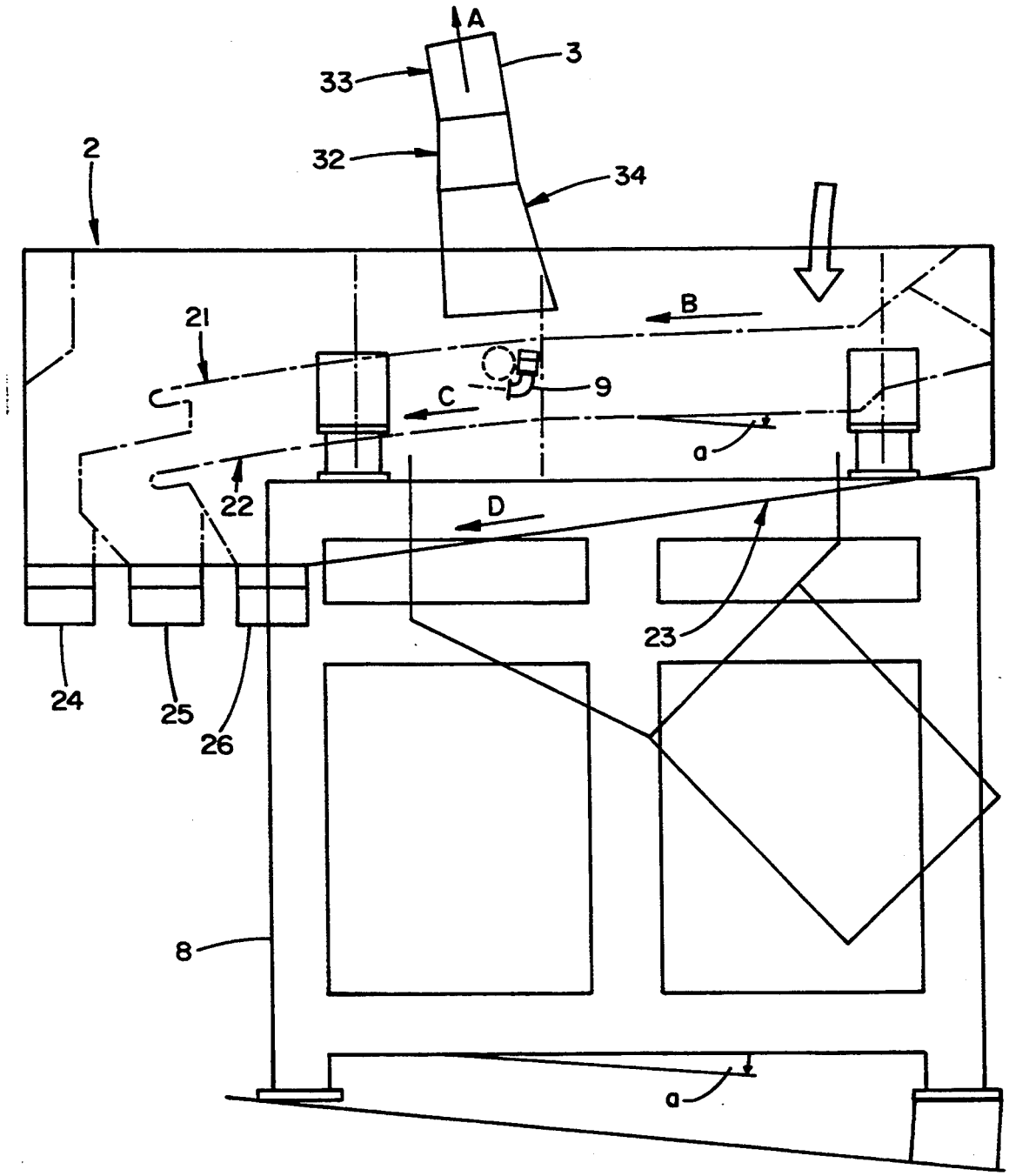

Further advantages and applications of the present invention are evident in the following detailed specification of an embodiment of the present invention in connection with the enclosed drawing in which:

FIG. 1 a schematic side view of an embodiment of the apparatus according to the invention for carrying out the method according to the invention, and FIG. 2 a more detailed side view of the vibrating conveyor device used in the embodiment according to FIG. 1.

The embodiment illustrated in FIGS. 1 and 2 of the apparatus according to the invention comprises essentially a separating device 1, 11 to 17 to which is fed the waste material or the cigarette discards, and a sorting device 2 to 9 to which is fed the waste material processed by the separating device 1, 11 to 17 for further processing.

The separating device 1, 11 to 17 comprises essentially a swinging hammer mill 1 in which is present a separating chamber 11 having an annular cross section. To the separating chamber 11 of the hammer mill 1 leads a funnel-form inlet 16 through which the waste material to be processed or to be reprocessed enters the separating chamber 11 of the hammer mill 1. The separating chamber 11 is bounded by a cylinder-form rotor 14 within the hammer mill 1 and by a stator 17 of the hammer mill 1.

On the circumference of the rotor 14 are fastened four radial jaws 12 or ribs disposed equidistantly from one another which project from the circumferential surface of the rotor 14 into the separating chamber 11. The rotor 14 of the hammer mill 1 is driven and rotated via a (not shown) drive with an electric motor. On the stator 17 of the hammer mill 1 are fastened at a distance from one another two stationary jaws 13 or ribs which project from the stator 17 into the separating chamber 11 of the hammer mill 1. When the radial jaws 12 on rotor 14 oppose one another, a distance in the range of 1 mm and 4 mm exists between the stationary jaws 13 and the radial jaws 12 rotating with the rotor 14. The jaws are layed out so that this distance can be adjusted.

From the separating chamber 11 extends an outlet 15 which is depicted in FIG. 1 as a continuous outlet port. Except for the inlet 16 and the outlet 15, the separating chamber 11 is closed off on all sides on the exterior through the housing 17 of the hammer mill 1 and in the interior by the rotor 14.

The sorting device 2 to 9 of the apparatus according to the invention comprises essentially a vibrating conveyor device 2 and a suction device 3 to 7.

The vibrating conveyor device 2 comprises a frame 27 of side metal sheets. The frame 27 bounds an essentially square space which in the downward direction is bounded by a bottom plate 23 and in the upward direction is essentially open. In the space between frame 27 and the bottom plate 23 are disposed a first sieve 21 and a second sieve 22 wherein the first sieve 21 extends over the second sieve 22 at a distance from the second sieve 22. On the bottom plate 23 of the vibrating conveyor device 2 are disposed in FIGS. 1 and 2 successive outlets at a distance from one another which are referred to as sieve outlet 24, residual paper outlet 25 and tobacco outlet 26. As is evident in FIG. 2, the vibrating conveyor 2 is disposed support 8. The mount 8 is inclined at an angle relative to the horizontal which extends at right angles to the direction of gravity so that an inclination of the vibrating conveyoer 2 relative to this horizontal results. In this manner, also an inclination of the flat sieves 21 and 22 results which essentially results plane-parallel to one another. The vibrating conveyor 2 and also the sieves 21 and 22 disposed in it are consequently disposed at an inclination wherein the end segment disposed above of the vibrating conveyor 2 is disposed below the outlet 15 of the hammer mill 1 so that waste material on the vibrating conveyor 2, processed in the hammer mill 1, can specifically fall onto the first sieve 21 in the region of the end segment disposed further above of the vibrating conveyor 2. The end segment region of the vibrating conveyor 2 opposing at a slant the end segment disposed above of the vibrating conveyor 2 comprises on the bottom plate 23 outlets 26, 25, and 24 wherein the tobacco outlet 26 is followed at a distance by the residual paper outlet 25, and finally the residual paper outlet 25 is, in turn, followed at a distance by the sieve outlet 24 disposed at the end of the vibrating conveyor at the end segment of the vibrating conveyor disposed further below.

The vibrating conveyor 2 together with frame 27, bottom plate 23 and sieves 21 and 22 are caused to vibrate or oscillate by means of a drive device.

The first sieve 21 and also the second sieve 22 are implemented as essentially planar flat sieves which in each instance are relatively slightly curved in the direction of the slanting end segment of the vibrating conveyor 2 so that the inclination generated by the incline of the vibrating conveyor of the first sieve 21 or the second sieve 22 is further reinforced by the curvature of the particular sieve whereby the throughput of the substance is locally increased in the direction toward the slanting end of the vibrating conveyor. The gap width or the dimensions of the sieve holes of the first sieve or the second sieve 22 are in each instance 5 mm or 2 mm (square hole sieve).

The suction device 3 to 7 comprises essentially a suction hood 3, a suction line 4, a deflection separator 5, a blower line 6, and a blower 7.

The suction hood 3 is disposed above the surface of the first sieve 21 of the vibrating conveyor device 2 at a distance to this surface and is connected through the suction line 4 with the deflection separator 5 so that air from the suction hood 3 can reach the deflection separator 5 via the suction line 4. The deflection separator 5 is connected at the output side with the blower line 6 which connects the deflection separator 5 with the blower 7 in terms of flow.

The suction hood 3 of the suction device 3 to 7 comprises essentially a lower part 31 resembling a sheet metal box without a cover or a bottom, onto which is placed an essentially similar center part 32 which changes over into an upper part 33 whose walls taper conically in the suction direction (indicated by A in FIGS. 1 and in 2). As can be seen in FIG. 2, the suction cross section of the lower part 31 is greater than the outlet cross section of the lower part 31 which comes about so that that the wall of the lower part 31 pointing to the end segment of the vibrating conveyor 2 disposed further above, extends obliquely with respect to this end segment in order to widen the cross section of the lower part 31. The suction hood 3 is disposed above the first sieve 21 at a distance from the end segment of the vibrating conveyor 2 disposed further above.

Below the first sieve 21 is disposed as a blowing device a nozzle strip 9 in the region underneath the suction hood 3 of the suction device. The nozzle strip 9 comprises a long nozzle body (not shown here) which comprises several nozzles implemented equidistantly one next to the other. The length of the nozzle body of the nozzle strip 9 corresponds essentially to the width of the first sieve 21 or the length of the suction hood 3, wherein the long nozzle body of the nozzle strip 9 is disposed transversely to the first sieve 21. The nozzle strip 9 blows air in the direction of the first sieve 21 extending above it and consequently also in the direction of the inlet cross section of the lower part 31 of the suction hood 3. The nozzle strip 9 is disposed in the region below the oblique wall of the lower part 31. The stream of air in the nozzle strip can be generated either by the blower 7 or by a separate blower.

Due to the curvature of the first sieve 21 or of the second sieve 22 of the vibrating conveyor 2 a different distance from the surface of the first sieve 21 to the inlet cross section of the suction hood 3 results wherein this distance increases when viewed in the direction of the end segment of the vibration conveyor 2 disposed further below.

It is further assumed that the waste material fed to the hammer mill 1 comprises cigarette discards from the production of filter cigarettes, tobacco, the paper material which is wrapped around the tobacco and filter plugs as filter material with tipping. This waste material is fed to the hammer mill 1 in the form of already processed cut discarded cigarettes.

After filling or feeding the waste material into the funnel-form inlet 16 of the hammer mill 1, the waste material reaches the separating chamber 11 of the hammer mill 1 where the waste material arrives via a carrier through the moving radial jaws 12 between the radial jaws 12 and the stationary jaws 13 of the hammer mill wherein the waste material is broken down mechanically and in the dry state and, in particular, the paper material which is wrapped around the tobacco and which is connected with the filter plug of the particular discarded cigarette, is separated from these material components of the waste material, i.e. the tobacco and the filter plugs. The distances between the stationary jaws 13 and the radial jaws 12 of the hammer mill 1 are adjusted so that the paper material or the paper shroud is largely removed or detached from the filter material or the filter plugs, and, on the other hand, the filter plugs are not destroyed in this separating process in the hammer mill, i.e. are not ground up, pressed too strongly or become frayed. The jaws 12 and 13 of the hammer mill are implemented so as to be variably adjustable in order to be able to be adapted to particular specifications of the waste material. After passing through the stationary jaws 13 the waste material broken down in this way is transported via the separating chamber 11 of the hammer mill 1 to the outlet 15 of the hammer mill 1 through the motion of the rotor 14 and the radial jaws 12 and it exits from outlet 15 and falls onto the vibrating conveyor 2 in the region of the end segment, disposed further above, of the oblique vibrating conveyor 2 onto the surface of the first sieve 21 of the vibrating conveyor 2. The waste material which now is located on the first sieve 21 is made to vibrate through the oscillation or vibration of the first sieve 21 or the entire vibrating conveyor 2, is there spread out over the width of the sieve surface and moves through the inclination or obliquity of the first sieve 21 on the surface of the first of the first sieve 21 downward in the direction toward the oblique end segment, disposed further below, of the vibrating conveyor 2, and the direction of motion of the waste material on the first sieve 21 is indicated by the direction arrow B of FIG. 1 or FIG. 2.

The waste material transferred from the hammer mill 1 to the vibrating conveyor 2, i.e. the waste material which now rests on the surface of the first sieve 21, comprises tobacco, paper material and filter plugs, the paper material is separated from the filter plugs, thus it is no longer connected with the filter plug material, and also is essentially separated from the tobacco.

By shaking or oscillating the first sieve 21 the waste material on it is distributed over the entire width of the first sieve 21 and moves downward on on the slope. There the tobacco which is relatively fine in comparison with the paper material and the filter plugs, falls through the sieve holes of the first sieve 21 onto the surface of the second sieve 22 which extends underneath the first sieve 21. On the first sieve 21 remain essentially the filter plugs and the paper material which is indeed separated from the filter plugs but which is still mixed with the filter plugs. This mixture of filter plugs and paper material moves on the first sieve 21 in the direction of arrow B under the suction hood 3 of the suction device. As soon as the paper material reaches the suction region of the suction hood 3, it is picked up, drawn into suction hood 3 and fed via the air stream in the suction line 4 to the reversing trap 5 in which the paper-laden air stream is purified, i.e. the paper material is deposited. (Instead of the deflection separator 5 a transverse or up-stream trap or a cyclone can alternatively be used.)

The amplitude of the oscillation or vibration, the cap width or sieve hole width and the angle of inclination a of the vibrating conveyor 2 are adjusted so that a mass stream of the waste material (paper sleeve and filter plugs with tipping) occurs which ensures an optimum suction of the paper material under the suction hood 3. The adjustments are carried out so that essentially a single layer of the broken-down waste material is present under the suction hood 3 in order to ensure the unhindered suction of the paper material from the filter plugs. The air stream exiting from the nozzle strip 9 gives to the paper material and the filter plugs in the region underneath the oblique wall of the lower part 31 of the suction hood 3 an additional impetus upward into the region of the strong suction air stream so that the air stream exiting from the nozzle strip 9 and the suction air stream in the suction hood 3 are adjusted relative to one another so that suctioning on or suctioning off of the paper material into the suction hood 3 and of the filter plugs remain on the sieve surface of the first sieve occurs. The paper material suctioned off is deposited in the deflection separator 5 while the filter plugs with tipping migrate further on the surface of the first sieve 21 in the direction of the arrow B to the oblique end of the vibrating conveyor where they are removed via the filter outlet 24 or where they can be filled for example into an appropriate bag.

The fine tobacco which has fallen onto the surface of the second sieve 22 is transported via the vibration and oscillation motion and the slope of the second sieve 22 into the direction of arrow C in FIG. 1 wherein in the tobacco potentially some residual paper is still contained. During the movement of these waste components in the direction of arrow C on the surface of the second sieve 22 the tobacco falls through the sieve holes of the second sieve 22 onto the bottom plate 23, whereas the residual paper remains essentially on the surface of the second sieve 22 and migrates in the direction of the residual paper outlet 25 where it is removed and can be filled for example into a bag.

The tobacco material falling on the bottom plate 23 under the second sieve 22 is transported through the vibration and oblique position of the bottom plate 23 in the direction of arrow D of FIG. 1 in the vibrating conveyor in order to be finally removed at the tobacco outlet 26 and filled into appropriate bags.

Optimum separating and sorting of the individual material components of the waste is obtained if the stream of the air volume which exits from the nozzle strip 9 is 4.5 $m^3$ per hour and the stream of the air volume in the suction hood 3 of the suction device is 180 $m^3$ per hour so that the vibrating conveyor oscillates at a frequency of 50 Hertz at maximum amplitude and the angle of inclination of the vibrating conveyor relative to the horizontal is 12 degrees of angle. The speed of the hammer mill 1 is for example 1450 rotations per minute, the distance of the jaws is between one to four millimeter and the diameter of the hammer mill can be for example 29.5 cm.

The jaws 12 of the hammer mill 1 are fastened immovably on the rotation part 14 during operation of the hammer mill 1. Alternatively the jaws 12 can be supported movably on the rotation part 14.

We claim:

1. In the production of filter cigarettes in which discard waste material is formed and said discard waste material comprises filter plugs, paper and tobacco, a process of separating and recovering said filter plugs, said paper and said tobacco, which consists essentially of the steps of:

1) introducing said discard material into the separating chamber (11) of a mill (1), disintegrating said discard waste material under dry conditions in said mill (1), said separating chamber (11) having an annular cross-section, said mill having a rotor (14), said rotor (14) having radial jaws (12), said mill (1) having a stator (17), said separating chamber being placed between said stator and said rotor, said rotor having a cylindrical shape with a circumferential surface, said radial jaws projecting from said circumferential surface into said separating chamber, said stator having stationary jaws (13), said stationary jaws projecting from said stator into said separating chamber, passing said discard waste material between said radial jaws (12) and said stationary jaws (13), said radial jaws (12) and said stationary jaws (13) being spaced from each other when they are opposite to each other during operation, whereby disintegrated discard waste material is obtained in which the paper is detached from the tobacco;

2) separating said paper, said tobacco and said filter plugs by first subjecting said disintegrated material to vibration and sifting through at least a first vibrating sieve (21) and a second vibrating sieve (22), said first vibrating sieve (21) being placed above said second vibrating sieve (22), removing said tobacco which still contains some residual paper through a first outlet (26); while said filter plugs and most of the paper remain on said first sieve (21), conveying the remainder of said discard material which contains paper and filter plugs along a conveyor which is downwardly inclined with respect to a horizontal line, suctioning off the major part of the paper by means of a blast driven suction device (3–7) located above said first sieve (21), blowing a gas onto the disintegrated material on said first sieve (21) by means of a blow device (9) located under said suction device, while said filter plugs remain on said first sieve (21), said residual filter paper remaining on said second sieve (22) being removed through a second outlet (25) and removing said filter plugs from said first sieve (21) through a third outlet (24).

2. The process according to claim 1 wherein in step 1) said radial jaws (12) and said stationary jaws (13) are at a distance of 1–4 mm during operation, when they are opposite one to the other.

3. The process according to claim 1 wherein during said step 2) the gas which is blown onto said first sieve is air.

4. The process according to claim 1 wherein said conveyor is inclined with respect to said horizontal line by an angle of 4–12 degrees.

5. The process according to claim 1 wherein said tobacco after having being removed through outlet (26) is subjected to additional sieving steps.

6. The process according to claim 1 wherein said paper and said tobacco are sieved several times during said second step 2).

7. An apparatus for the separation and recovery of tobacco, paper and filter plugs from discard material which accumulates during the production of filter cigarettes, which comprises a mill (1) for disintegrating said waste material, said mill (1) having a separating chamber (11), an inlet (16) for introducing said discard material into said separating chamber, a rotor (14) and a stator (17), said separating chamber having an annular cross-section, said rotor having radial jaws (12), said stator having stationary jaws (13), said rotor having a cylindrical shape with a circumferential surface, said radial jaws projecting from said circumferential surface into said separating chamber, said separating chamber being located between said stator and said rotor, said stationary jaws projecting from said stator into said separating chamber, said radial jaws (12) and said stationary jaws (12) being spaced from each other during operation when they are arranged opposite to each other, an outlet (15) from said mill, a sorting device comprising a vibrating conveyor (2) for vibrating the disintegrated material, first sieve (21) for sieving the waste material whereby tobacco with some residual paper is removed from said sieve (21) through a first outlet (26), said conveyor (2) being inclined downwardly with respect to a horizontal line for carrying the remainder of said discard material containing paper and filter plugs to a second sieve (22) located under said first sieve, means for suctioning off the major part of the paper comprsing a suction hood (3) located above said first sieve (21) for suctioning off the major part of said paper, blow means (9) for blowing a gas onto said first sieve (21), said blow means being located under said suction hood (3), means (25) for removing said residual paper and means (24) for removing said filter plugs.

8. The apparatus according to claim 7 wherein said vibrating conveyor (2) is inclined downwardly with respect to a horizontal line by an angle 4–12 degrees.

9. The apparatus according to claim 7 wherein the distance of said radial jaws (12) and said stationary jaws (13) during operation when they are opposite to each other is adjustable.

10. The apparatus as to claim 9 wherein during operation said jaws (12) and said stationary jaws (13) are spaced at a distance of 1–4 mm, when they are opposite to each other.

11. The apparatus according to claim 7 wherein said gas being blown is air and said means for blowing air comprises a nozzle strip (9).

12. The apparatus as to claim 11 wherein said nozzle strip is located below the suction hood (3) and said first vibrating sieve (21) is located between said suction hood (3) and said nozzle strip.

13. The apparatus according to claim 11 wherein said second sieve (22) is located under said blowing device.

14. The apparatus according to claim 7 wherein said means for suctioning off the paper comprises a separation device, said separation device consisting of a deflection separator trap (5).

15. The apparatus according to claim 7 wherein said suction hood (3) comprises a lower part (31), a central part (32) and an upper part (33), said upper part (33) having walls which taper in the direction of suction and said lower part (31) has a cross section larger at the bottom compared to the top thereof.

* * * * *